US005588361A

United States Patent [19]

Riis

[11] Patent Number: 5,588,361

[45] Date of Patent: Dec. 31, 1996

[54] DEVICE AND METHOD FOR INSERTING OR REMOVING OPERATING PARTS INTO OR FROM A PRINTING MACHINE

[75] Inventor: Einar K. Riis, Skodsborg, Denmark

[73] Assignee: Werner Kammann Maschinenfabrik GmbH, Bunde, Germany

[21] Appl. No.: 500,902

[22] PCT Filed: Feb. 2, 1994

[86] PCT No.: PCT/DK94/00051

§ 371 Date: Jul. 28, 1995

§ 102(e) Date: Jul. 28, 1995

[87] PCT Pub. No.: WO94/18007

PCT Pub. Date: Aug. 18, 1994

[30] Foreign Application Priority Data

Feb. 3, 1993 [DK] Denmark ..... 126/93

[51] Int. Cl.[6] ..... B41F 13/20; B41F 13/40; B41F 13/44

[52] U.S. Cl. ..... 101/216; 101/486; 101/352

[58] Field of Search ..... 101/216, 219, 101/212, 181, 152, 153, 177, 182, 184, 185, 247, 351, 352, 207–210, 479, 480, 485, 486

[56] References Cited

U.S. PATENT DOCUMENTS 4,137,843 2/1979 Ottenhue ..... 101/153
4,887,531 12/1989 Ichikawa et al. ..... 101/153
5,142,978 9/1992 Borel ..... 101/177

FOREIGN PATENT DOCUMENTS 2632455 1/1978 Germany .
WO94/18006 8/1994 WIPO .

*Primary Examiner*—J. Reed Fisher
*Attorney, Agent, or Firm*—Pennie & Edmonds

[57] ABSTRACT

When operating parts, such as a plate cylinder (3), a chamber doctor blade (4), an inking cylinder (5) and an ink trough (6), are to be inserted in a printing machine (13), said operating parts (3,4,5,6) are temporarily secured to a frame (2) adapted to move on a carriage (1) transversely to the latter's direction of motion. Then, the carriage (1) is placed in position in front of the printing machine (13), the front panel of which has previously been removed. After this, the frame (2) is run partially into the printing machine (13), causing the operating parts (3,4,5,6) to be released from the frame (2), after which a device in the printing machine (13) transfers them to their final positions, in which they are held securely in the printing machine (13). When said operating parts (3,4,5,6) are to be removed from the printing machine (13), the procedure is carried out in the reverse sequence.

4 Claims, 6 Drawing Sheets

DEVICE AND METHOD FOR INSERTING OR REMOVING OPERATING PARTS INTO OR FROM A PRINTING MACHINE

TECHNICAL FIELD

The present invention generally relates to printing machines and, more particularly, to a device and method for selectively inserting or removing operating parts into or from a printing machine.

More particularly, operating parts may be interchangeable parts of a printing machine for letterpress printing, photogravure or rotogravure, offset printing, flexography, electronic printing or silk-screen printing, but also operating parts of a machine incorporated in a printing line for performing related operations such as "hot melt", cold sealing, lamination, "hot foil", punching or embossing,

BACKGROUND ART

An example of a known printing machine is shown in DE-B2-2632455. This known device is designed for the exchanging of such operating parts as an inking unit and a printing cylinder but also a counter-pressure cylinder of a photo- or rotogravure printing machine and comprises a carriage having means for supporting the said parts thereon. After having been run into a position in front of the printing machine, and the front panel thereof has been removed, the wheel-axes of the carriage are turned through 90 degrees by means of a linkage. Thereafter the carriage is as a whole drawn into the housing of the printing machine by means of an endless chain. The whole exchange of the said parts as well as their securing in and loosening from the printing machine, respectively, is done manually. There is not shown or disclosed any means to securely hold the cylinders on the carriage.

SUMMARY OF THE INVENTION

In one aspect of the present invention, a device and method is disclosed for selectively inserting or removing operating parts into or from a printing machine. The device comprises a carriage and a frame mounted on the carriage for movement relative thereto into and out of the printing machine. The frame has a first releasable securing means for releasably securing at least one of the operating parts to be selectively inserted or removed. The device further includes a second releasable securing means, for releasably securing at least one of the operating parts to be inserted or removed, and individual power-driven transfer means adapted after releasing of said second releasable securing means to transfer at least one of the operating parts from the first releasable securing means on the frame to the second releasable securing means in the printing machine after releasing thereof, and vice versa. The device further includes means for bringing the first and second releasable securing means into their securing positions when removing the frame from the printing machine.

It is an object of the invention to provide a device of the said kind which will make possible an easy and non-manual inserting or removing of operating parts as the initially mentioned into or from a printing machine, and where those parts are securely held on the carriage during their transport thereon.

BRIEF DESCRIPTION OF THE DRAWINGS

In the following detailed portion of the present description, the invention will be explained in more detail with reference to the exemplary embodiment of a device according to the invention shown in the drawing, in which FIG. 1 in perspective shows a carriage with a frame, in which are placed Operating parts to be inserted in a printing machine.

DESCRIPTION OF THE PREFERRED EMBODIMENT

Figure 1:
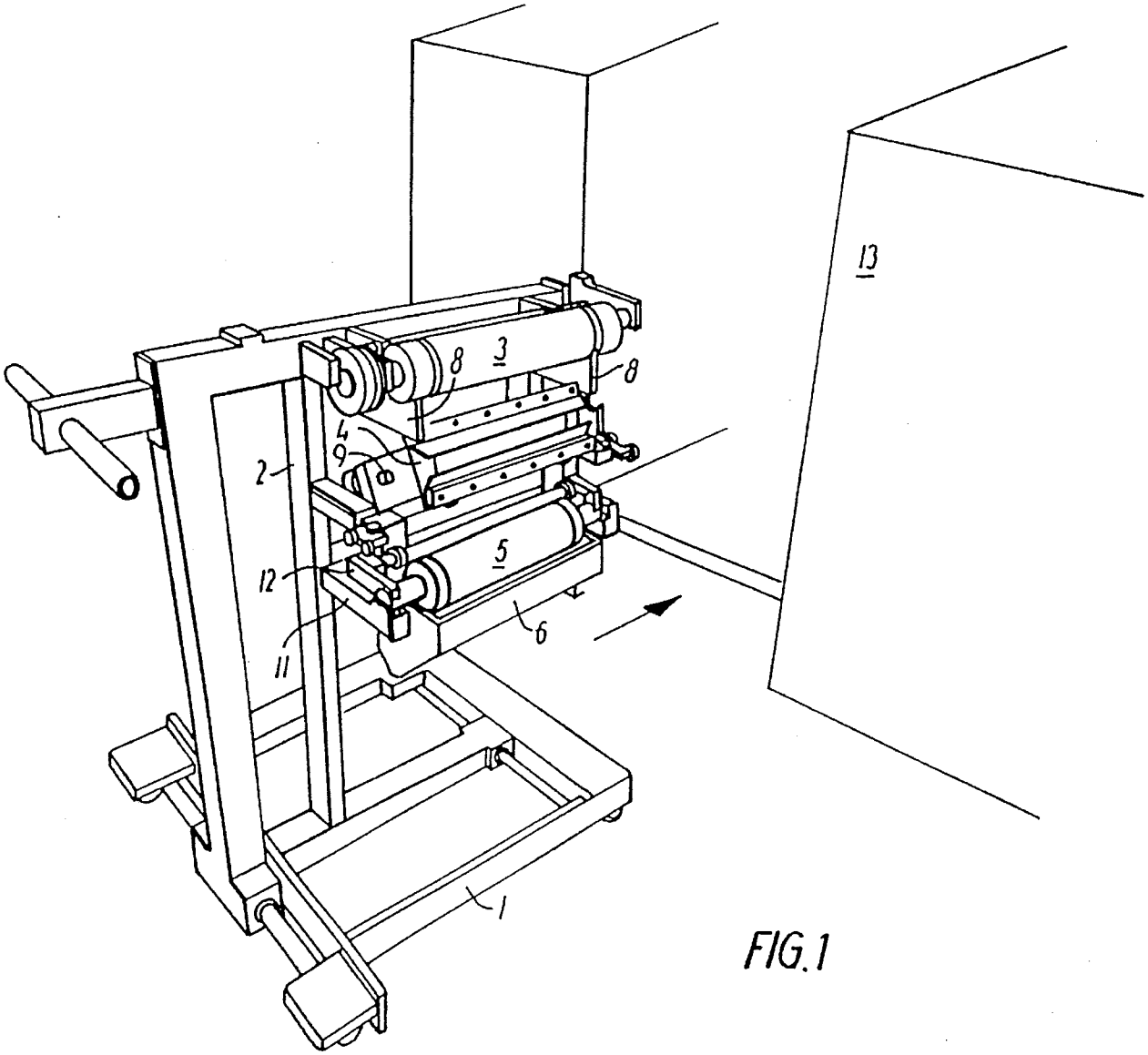

FIG. 1 shows a carriage 1, on which a frame 2 is supported for translatory movement transversely of the direction of movement of the carriage, said frame 2 supporting a plate cylinder 3, a doctor blade 4, an inking cylinder 5 and an ink trough 6, all to be inserted into a printing machine 13. As shown with an arrow, the carriage 1 may be moved in through the front side of the printing machine 13, the front panel of which has previously been removed.

Figure 2:
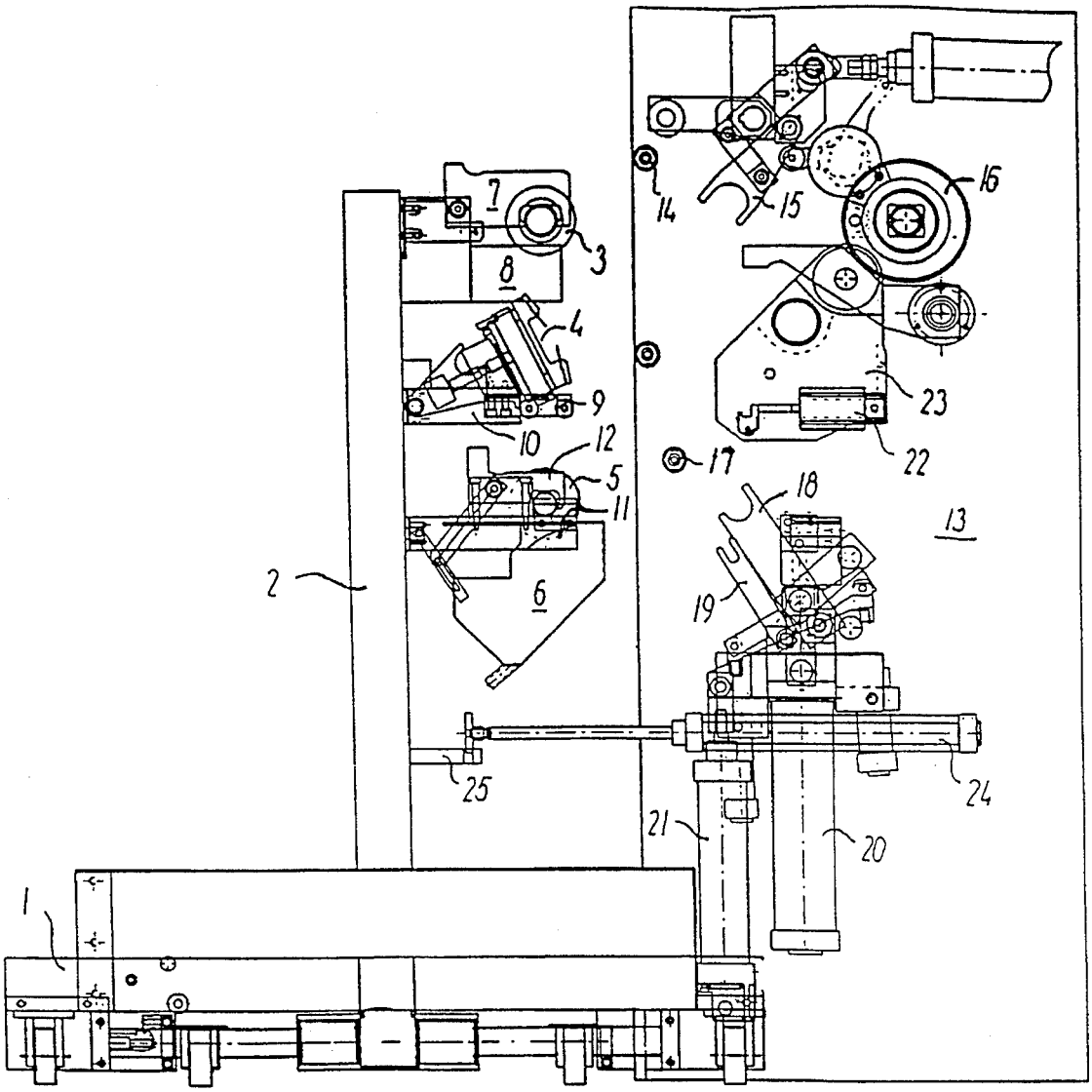
FIGS. 2–5 show various stages during the insertion of the operating parts in the printing machine.

As may be seen more clearly from FIG. 2, the stub shafts of the plate cylinder 3 are held onto brackets 8 on the frame 2 by means of pivoted hooks 7. In a corresponding manner, the stub shafts of the inking cylinder 5 are held onto brackets 11 on the frame 2 by means of pivoted hooks 12. The ink trough 6 is also held by these brackets 11. The doctor blade 4 is secured to a carriage 9, the wheels of which are guided in tracks in brackets 11 on the frame 2.

Figure 3:
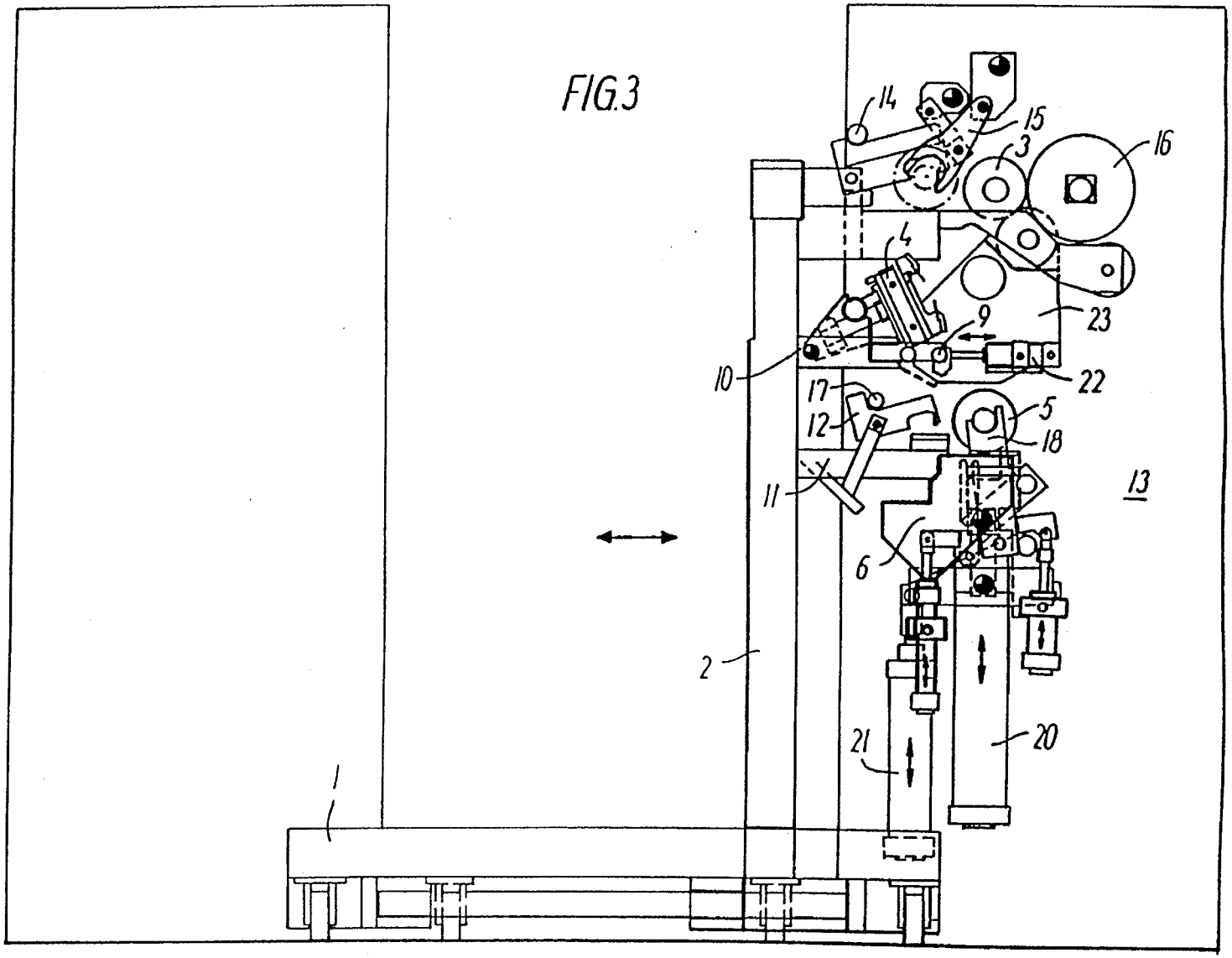

As shown in FIG. 2, a piston rod in a piston-cylinder unit 24 in the printing machine 13 has been moved forward to engage a recess in a projection 25 on the frame 2, the latter then, when this piston rod is retracted, being shifted on the carriage 1 until it is in the position partly inside the printing machine 13 as shown in FIG. 3.

Figure 4:
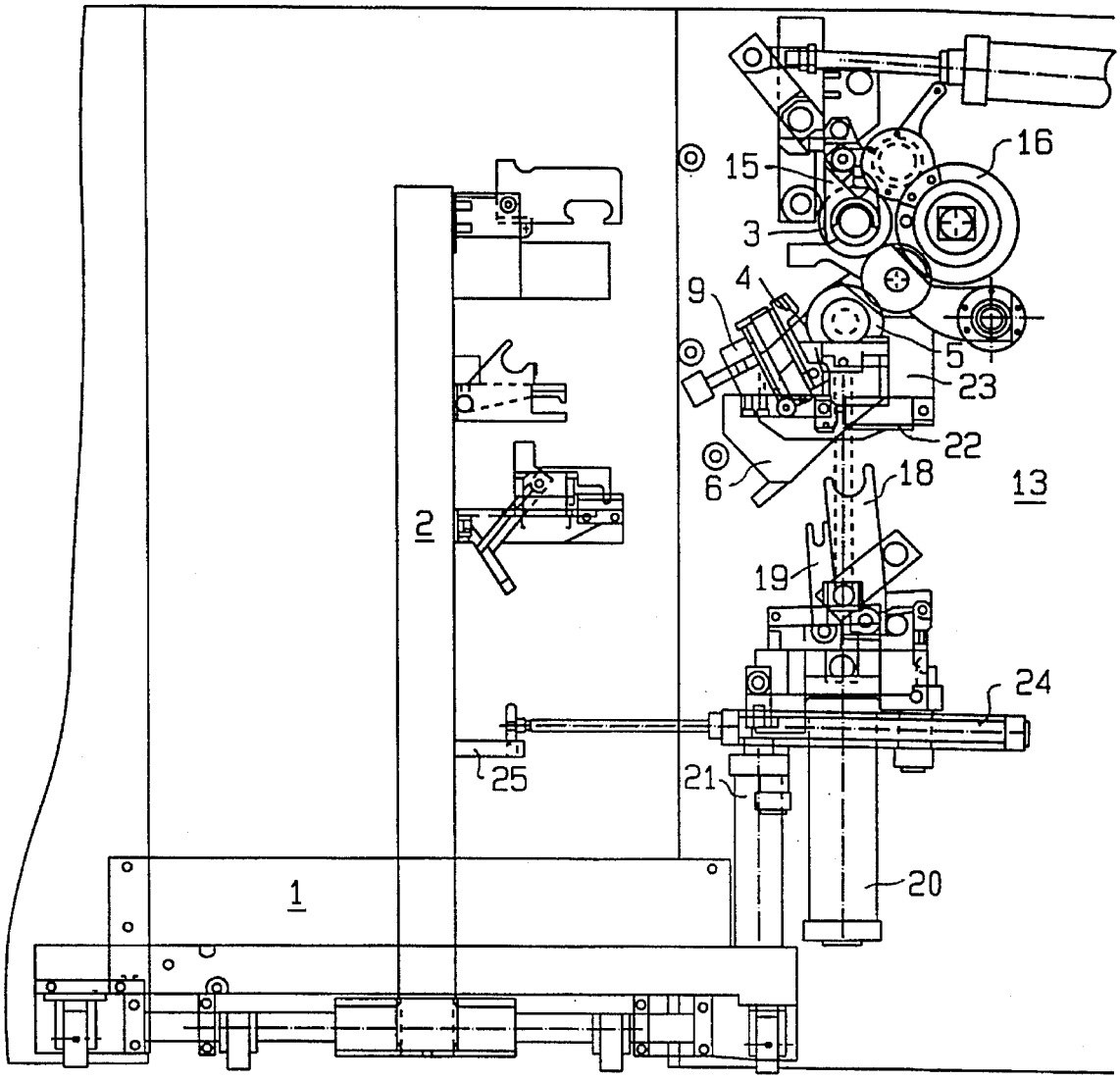
Figure 5:
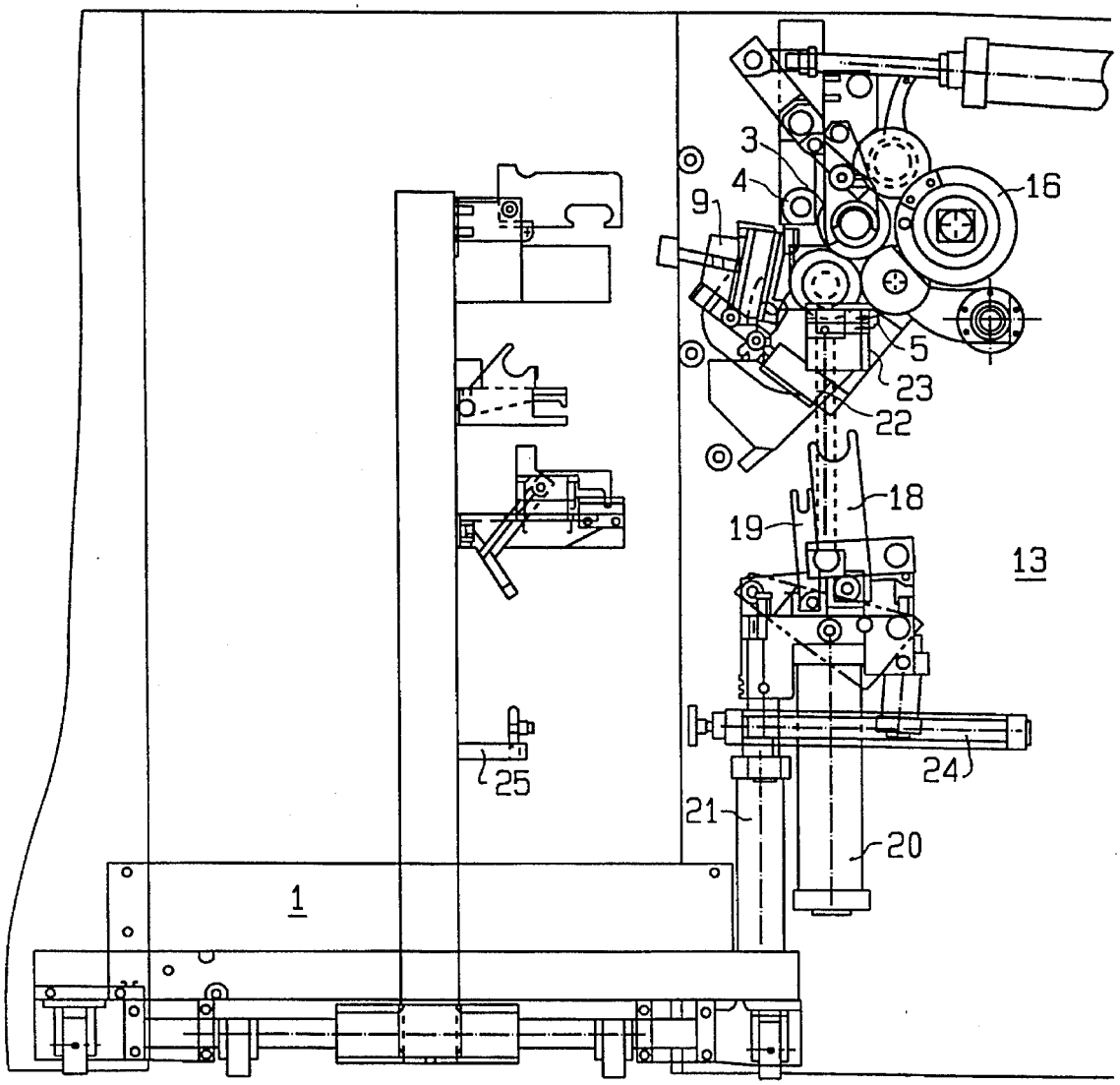

In this position of the frame 2, fixed stops 14 and 17 in the printing machine 13 have come into engagement with the pivoted hooks 7 and 12, thus freeing the stub shafts for the plate cylinder 3 and the inking cylinder 5. The stub shafts of the plate cylinder 3 are now engaged by pivoted forks 15 in the printing machine 13, said forks moving the plate cylinder 3 to its final position in the printing machine 13, in which it is held against a counterpressure cylinder 16 by means not shown in detail. After this, the stub shafts of the inking cylinder 5 are engaged by pivoted forks 18 and made to swing to a position vertically below pivoted brackets 23 in the printing machine 13, after which the inking cylinder 5 is elevated by a piston-cylinder unit 20 in the printing machine 13 to a position, in which it is held firmly between these pivoted brackets 23. At the same time, studs en the ink trough 6 have been gripped by pivoted forks 19, cf. FIGS. 2 and 4, and elevated by a piston-cylinder unit 21 in the printing machine 13 to be held in a position below the pivoted brackets 23. After the pivoted forks 18 and 19 have been withdrawn by means of the piston-cylinder units 20 and 21, the piston rod in a piston-cylinder unit 22 in the printing machine 13 is brought into engagement with the carriage 9, on which the doctor blade 4 is secured, and moves the carriage 9 from the tracks in the brackets 10 on the frame 2 into tracks in the pivoted brackets 23 in the printing machine 13, thus causing the doctor blade 4 to be brought into operative abutment against the inking cylinder 5 as shown in FIG. 4, this Figure likewise showing that the frame 2, from which the operating parts 3,4,5 and 6 now have been removed, is again shifted by the piston rod in the piston-cylinder unit 24 on the carriage 1 outwardly from its position partly inside the printing machine 13 to its position in front of the latter, after which the piston rod in the piston-cylinder unit 24 is freed from the projection 25 on the frame 2 and withdrawn as shown in FIG. 5, this Figure likewise showing that the pivoted brackets 23 in the printing machine 13 have been pivoted upwardly to a position, in which the surface of the inking cylinder 5 abuts against the surface of the plate cylinder 3.

It is now possible to replace the front panel on the printing machine 13, and the carriage 1 may be moved away from its position in front of the printing machine 13.

When the parts 3, 4, 5 and 6 are to be removed from the printing machine 13, the process is carried out in the opposite sequence.

Figure 6:
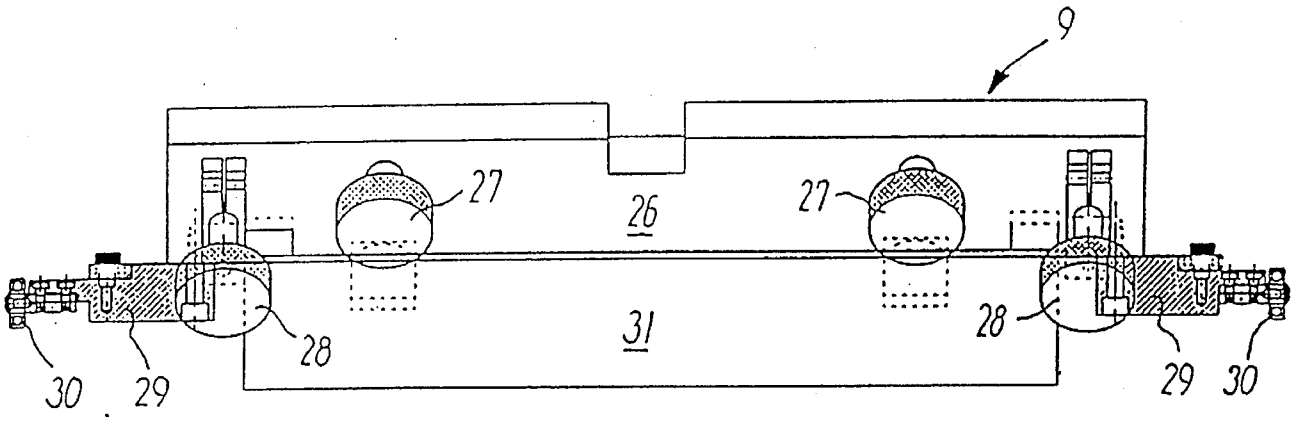
FIG. 6 shows another carriage adapted for holding one of the operating parts.
Figure 7:
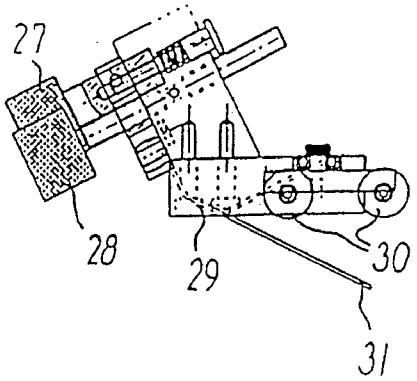
FIG. 7 is an end view of the carriage shown in FIG. 6.

FIG. 6 shows, partly from the rear and partly from the side, the carriage 9, in the embodiment described above being used for holding the doctor blade 4, but it may be modified for use in holding other operating parts in a printing machine.

The carriage 9 comprises an oblique plate member 26 abutting against the rear of the doctor blade and having screws 27 and 28 for securing the latter. At the ends of the plate member 26 blocks 29 are secured, having wheels 301for engagement in the tracks for guiding the carriage 9. Further, the carriage 9 is provided with a lower oblique plate member 31 extending across the width of the doctor blade, adapted to guide ink dripping from the doctor blade down into the ink trough 6.

It will be appreciated that it will be possible to remove and replace the counterpressure cylinder 16 shown in the drawing in a similar manner as described above with regard to the parts 3, 4, 5 and 6, by using a carriage corresponding to the carriage 1 and adapted to be placed in position at the rear of the printing machine 13, when the latter's rear panel has been removed. It will also be appreciated that each step of the method of the present invention can be controlled sequentially by a computer.

LIST OF PARTS

1 Carriage
2 Frame
3 Plate cylinder
4 Doctor blade
5 Inking cylinder
6 Ink trough
7 Hook
8 Bracket
9 Carriage
10 Bracket
11 Bracket
12 Hook
13 Printing machine
14 Fixed stop
15 Fork
16 Counterpressure cylinder
17 Fixed stop
18 Fork
19 Fork
20 Piston-cylinder unit
21 Piston-cylinder unit
22 Piston-cylinder unit
23 Bracket
24 Piston-cylinder unit
25 Projection
26 Oblique plate member
27 Screw
28 Screw
29 Block
30 Wheel
31 Lower oblique plate member

I claim:

1. A device for selectively inserting and removing operating parts (3,4,5,6) into and from a printing machine (13) having a removable front panel, said device comprising:

a) a carriage (1) adapted to be placed in a position facing said removable front panel in the printing machine (13);

b) a frame (2) mounted on said carriage (1) for movement transversely relative thereto into and out of the printing machine (13) after said front panel has been removed, said frame having first releasable securing means (7,8, 10,11,12) for releasably securing at least one of said operating parts (3,4,5,6) to be selectively inserted and removed, said first releasable securing means being released by cooperation with releasing means (14,17) situated in the printing machine (13);

c) second releasable securing means situated in the printing machine (13) for releasably securing at least one of said operating parts (3,4,5,6) to be selectively inserted and removed;

d) individual power-driven transfer means (15,18,19,20, 21,22) adapted after releasing of said second releasable securing means to transfer at least one of said operating parts (3,4,5,6) from the first releasable securing means (7,8,10,11,12) on the frame (2) to the second releasable securing means in the printing machine (13) after releasing thereof, and vice versa; and e) means situated in the printing machine (13) adapted to bring the first and second releasable securing means into their securing positions when removing the frame (2) from the printing machine (13).

2. The device of claim 1, wherein at least one (4) of the operating parts is secured to another carriage (9) adapted to be transferred from slide tracks in brackets (10) on the frame (2) to slide tracks in pivoted brackets (23) in the printing machine (13), and vice versa.

3. A method for selectively inserting and removing operating parts into and from a printing machine (13) having a removable front panel by using a device including a first carriage (1) adapted to be placed in a position facing said removable front panel in the printing machine (13), a frame (2) mounted on said first carriage (1) for movement transversely relative thereto into and out of the printing machine (13) after said front panel has been removed, said operating parts including a plate cylinder (3) having stub shafts, a chamber doctor blade (4), an inking cylinder (5) having stub shafts, and an ink trough (6) having stubs, said frame having first releasable securing means (7,8,10,11,12) for releasably securing at least one of said operating parts (3,4,5,6) to be selectively inserted and removed, said first releasable securing means being released by cooperation with releasing means (14,17) situated in the printing machine (13), second releasable securing means situated in the printing machine (13) for releasably securing at least one of said operating parts (3,4,5,6) to be selectively inserted and removed, individual power-driven transfer means (15,18, 19,20,21,22) adapted after releasing of said second releasable securing means to transfer at least one of said operating parts (3,4,5,6) from the first releasable securing means (7,8,10,11,12) on the frame (2) to the second releasable securing means in the printing machine (13) after releasing thereof, and vice versa, means situated in the printing machine (13) adapted to bring the first and second releasable securing means into their securing positions when removing the frame (2) from the printing machine (13), and at least the chamber doctor blade (4) of the operating parts being secured to a second carriage (9) adapted to be transferred from slide tracks in brackets (10) on the frame (2) to slide tracks in pivoted brackets (23) in the printing machine (13), and vice versa, said method comprising the following steps for inserting said operating parts:

a) placing into the frame (2) in sequence the following:
   1) the plate cylinder (3) with its stub shafts abutting against first brackets (8) on the frame (2) and held by first pivoted holding hooks (7),
   2) the chamber doctor blade (4) secured to the second carriage (9) in second brackets (10) in the frame (2),
   3) the inking cylinder (5) secured with its stub shafts abutting against third brackets (11) on the frame (2) and held by second pivoted hooks (12), and
   4) the ink trough (6) suspended in said third brackets (11);

b) moving the first carriage (1) into a position facing the front of the printing machine (13) after said front panel has been removed and moving the frame (2) into the printing machine (13), so that stops (14,17) in the printing machine (13) engage said holding hooks (7,12) holding the stub shafts of, the plate cylinder (3) and the inking cylinder (5), respectively, and freeing said stub shafts;

c) gripping the stub shafts of the plate cylinder (3) by pivoted forks (15) in the printing machine (13) and by means of said pivoted forks (15) transferring the plate cylinder to a final securely held position in the printing machine (13);

d) gripping the stub shafts of the inking cylinder (5) and studs on the ink trough (6) by pivoted forks (18,19)and swinging the inking cylinder (5) and the ink trough (6) to a position below said pivoted brackets (23) in the printing machine, as well as elevating the inking cylinder (5) and the ink trough (6), by means of first and second fluid-driven piston-cylinder units (20,21), to securely held positions in and below said pivoted brackets (23) respectively;

e) engaging the second carriage (9) of the chamber doctor blade (4) by a piston in a third fluid-driven piston-cylinder unit (22) in the printing machine (13) and withdrawal of said piston, so that wheels (30) on said second carriage (9) are moved into tracks in the pivoted brackets (23) in the printing machine (13);

f) removing the frame (2) from the printing machine (13);

g) swinging the pivoted brackets (23) with the inking cylinder (5) and the chamber doctor blade (4) to final positions of the latter in the printing machine (13); and h) placing the front panel on the printing machine (13).

4. The method of claim 3, further including the following steps for removing said operating parts (3,4,5,6) from the printing machine (13):

a) moving the first carriage (1) to a position facing the side of the printing machine (13) after the latter's front panel has been removed, and moving an empty frame (2) into the printing machine (13), so that said holding hooks (7,12) are lifted by the stops (14,17);

b) swinging the pivoted brackets (23) with the chamber doctor blade (4) and the inking cylinder (5) to a removal position;

c) moving the second carriage (9) of the chamber doctor blade (4), by means of said piston-cylinder unit (22), from the tracks in the pivoted brackets (23) in the printing machine (13) to the tracks in the second brackets (10) on the frame (2);

d) freeing the inking cylinder (5) and the ink trough (6) from a position in which they have been held in and below the pivoted brackets (23), respectively, and removing the inking cylinder (5) and the ink trough (6) by means of said first and second piston-cylinder units (20,21) and placing them on the third brackets (11) on the frame (2) by means of said pivoted forks (18,19);

e) freeing the plate cylinder (3) from a position in which it has been held in the printing machine (13), and swinging the stub shafts of said plate cylinder by means of the forks (15) to a position on the brackets (8) on the frame (2); and f) removing the frame (2) from the printing machine (13), so that said holding hooks (7,12) are moved into a securing position above the stub shafts of the plate cylinder (3) and the inking cylinder (5), respectively.

* * * * *